US005995062A

United States Patent [19]

Denney et al.

[11] Patent Number: 5,995,062

[45] Date of Patent: Nov. 30, 1999

[54] PHASED ARRAY ANTENNA

[75] Inventors: Peter M. Denney, Melbourne Beach; Roger Wayne Strange, Palm Bay, both of Fla.

[73] Assignee: Harris Corporation, Palm Bay, Fla.

[21] Appl. No.: 09/026,299

[22] Filed: Feb. 19, 1998

[51] Int. Cl.[6] ..... H01Q 1/38

[52] U.S. Cl. ..... 343/853; 343/700 MS; 343/893; 343/895

[58] Field of Search ..... 343/700 MS, 893, 343/853, 895, DIG. 2, 754, 872, 352, 376, 354; H01Q 1/38

[56] References Cited

U.S. PATENT DOCUMENTS

| | | | |
|---|---|---|---|
| 3,100,892 | 8/1963 | FCutler | 343/100 |
| 3,805,266 | 4/1974 | Fletcher et al. | 343/708 |
| 4,918,458 | 4/1990 | Brunner et al. | 343/795 |
| 4,924,235 | 5/1990 | Fujisaka et al. | 342/374 |
| 5,103,233 | 4/1992 | Gallagher et al. | 342/408 |
| 5,146,230 | 9/1992 | Hules | 342/374 |
| 5,200,756 | 4/1993 | Feller | 343/700 MS |
| 5,243,354 | 9/1993 | Stern et al. | 343/700 MS |
| 5,291,211 | 3/1994 | Tropper | 343/890 |
| 5,442,366 | 8/1995 | Sanford | 343/700 MS |
| 5,543,807 | 8/1996 | Stangel | 342/374 |
| 5,543,811 | 8/1996 | Chethik | 343/844 |
| 5,552,798 | 9/1996 | Dietrich et al. | 343/893 |
| 5,570,102 | 10/1996 | Kochiyama et al. | 343/880 |
| 5,650,788 | 7/1997 | Jha | 343/700 MS |

*Primary Examiner*—Hoanganh Le
*Attorney, Agent, or Firm*—Allen, Dyer, Doppelt, Milbrath & Gilchrist, P.A.

[57] ABSTRACT

A phased array antenna includes a plurality of planar panels each having opposing sides and top and bottom edges and forming an antenna face. Each planar panel is disposed circumferentially about a central axis and is connected to adjacent panels along the sides thereof. Each panel is inclined toward the central axis from the bottom edge. A plurality of antenna elements are positioned on each panel. Each panel includes substantially the same number of antenna elements as adjacent panels and forms an antenna array on each antenna face. A plurality of transmit/receive modules generates and receives signals, and each transmit/receive module corresponds to a respective antenna element on an antenna array. Means connects each of the transmit/receive modules to respective pluralities of the antenna elements within each array. A switch collectively controls the connection of the transmit/receive modules to respective antenna elements of one selected antenna array so that the transmit/receive modules are collectively connected to respective antenna elements of a selected antenna array at a selected time.

39 Claims, 3 Drawing Sheets

PHASED ARRAY ANTENNA

FIELD OF THE INVENTION

This invention relates to antennas, and more particularly, to phased array antennas.

BACKGROUND OF THE INVENTION

Radar systems and other communication systems using high frequency signals, such as in the gigahertz range, typically require a sophisticated antenna system that has a very high coverage, including 360° azimuth coverage and a high range in elevation. Some antenna systems provide a 360° azimuth coverage and a high elevation range without having to mechanically move the antenna. Other antenna systems require complicated motors and gears for moving an antenna mast. These antennas may include a plurality of antenna elements positioned on an antenna face, forming an antenna array. Some antenna arrays were mechanically steered, with a power splitter driven by a single amplifier, or a multi-panel phased array having a transmit/receive module positioned behind each antenna element. Some of these systems also required complex controllers or were physically large, and thus, not mobile.

U.S. Pat. No. 5,243,354 to Stern, et al., U.S. Pat. No. 5,543,811 to Chethik, and U.S. Pat. No. 5,552,798 to Dietrich, et al. all disclose multi-panel antennas for allowing 360° azimuth coverage. In the '798 Dietrich patent, antenna elements are supported by various panels of an antenna mast. The antenna panels enable a spread spectrum communication between terminals over a range of elevation angles. However, the system requires a centralized radio frequency power source.

U.S. Pat. No. 5,146,230 to Hules discloses a radar array using only transmit/receive modules to make it possible to generate a radio frequency signal directly at an antenna element and set the relative phase relationships between the elements. The transmit/receive modules also pre-amplify a receive signal. These transmit/receive modules avoid those problems related to a totally centralized radio frequency power source. For example, those antenna feed systems using a centralized radio frequency power source usually have constrained feed or space feed power distribution systems. Typically, these centralized systems also have dividers and combiners that could introduce undesirable inter-element interference and losses.

In the '230 patent to Hules, these drawbacks of using centralized feed systems are overcome by the use of active transmit/receive modules that generate the radio frequency power directly at the antenna elements. Thus, the relative phase relationship between the elements can be established. Additionally, individual transmit/receive modules allow preamplification of the received signal within an amplifier that is part of the transmit/receive module. However, in many systems, the transmit/receive modules were placed at each antenna element, adding to the production costs, the weight of the overall unit, and efficiency of the design.

The antenna system disclosed in the '230 patent to Hules overcomes this problem by using a switching mechanism that controls the connection of each transmit/receive module to a passive antenna element. Thus, each transmit/receive module is connected to only one antenna element at a time. The switches are controlled so that the active transmit/receive module is connected to desired patterns of passive antenna elements that are circularly arranged in an annular layered configuration. The antenna elements and active transmit/receive modules are positioned along the outer portions of respective antenna layers, with various antenna connecting leaves located in anterior portions of the layers. The switch is operable to connect the active transmit/receive modules with successive patterns of mutually adjacent antenna elements to produce antenna beams with desired directionality and phase relationships.

However, the antenna structure disclosed in the '230 patent to Hules discloses an annular configuration that has only a circular antenna face, and a constant circular arrangement of antenna elements that are organized into three 120° sectors, A, B and C, of four passive antenna elements each. Although a 360° azimuth is covered, the surface of the various sectors forming an antenna face are perpendicular to the ground, and do not appear to provide adequate elevation range. Additionally, the antenna elements are arranged along a 120° sector forming part of the annular face. Thus, none of the different antenna elements forming an array are disposed in one plane, which would aid in beam forming.

SUMMARY OF THE INVENTION

It is therefore an object of the present invention to provide a phased array antenna with 360° azimuth coverage, where an array of antenna elements are positioned on a planar face.

It is another object of the present invention to provide a phased array antenna that can switch respective transmit/receive modules to respective antenna elements of an antenna array that is formed on a planar face to provide 360° azimuth coverage and a high range in elevation.

In accordance with the present invention, a phased array antenna includes a plurality of planar panels, each having opposing sides on top and bottom edges and forming an antenna face. The planar panels are disposed circumferentially about a central axis. Each panel is connected to adjacent ones of the panels along the sides thereof and inclined toward the central axis from the base. A plurality of antenna elements are positioned on each panel. Each panel has substantially the same number of antenna elements as adjacent panels and forms an antenna array on each antenna face. The plurality of transmit/receive modules generates and receives signals. Each transmit/receive module corresponds to a respective antenna element on an antenna array. Means connects each of the transmit/receive modules to respective pluralities of the antenna elements within each array. Switch means selectively controls connection of the transmit/receive modules to respective antenna elements of one selected antenna array so that the transmit/receive modules are collectively connected to respective antenna elements of a selected antenna array at one time.

In accordance with one aspect of the present invention, the planar panels are substantially trapezoidal in shape. The plurality of planar panels comprise eight panels forming an octahedron. A base supports the transmit/receive modules, connecting means and switch means, and means connect the base along the bottom edges of the panels so that the base acts as a support for the planar panels and the electronic components forming the various transmit/receive modules and other circuit components. Legs can depend from the base to act as a support to the base for supporting the entire phased array antenna in one location and adding mobility to the antenna.

In still another aspect of the present invention, the panels are inclined at an angle such that the antenna elements cover a +15 to +60 degree elevation in transmitting and receiving panels. The antenna elements further comprise helical antennas. Each panel forms an antenna face and comprises sixteen antenna elements. The sixteen antenna elements are arranged in a four by four matrix. The phased array antenna further comprises means for generating a radio frequency signal, and a signal divider connected to the plurality of transmit/receive modules for receiving the generated radio frequency signal and dividing the radio frequency signal into separate discrete signals that are forwarded to the transmit/receive modules. Means for generating a radio frequency further comprises a transmit/receive switch, which switches between transmit and receive modes. The controller is operatively connected to the switch means for controlling the switching of the switch means between various antenna faces and respective antenna elements. A planar top can be connected along the top edges of the panels. Each respective transmit/receive module further comprises a phase shifter to establish the phase of a transmit/receive module output relative to other transmit/receive modules to thereby direct a desired antenna beam.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The phased array antenna of the present invention is advantageous over the prior art antenna systems because it not only provides a high volumetric coverage without mechanically moving the antenna, but also uses transmit/receive modules that generate radio frequency power directly at the antenna element to set the relative phase relationships between the elements. Additionally, the phased array antenna of the present invention has low radio frequency losses. It also provides for a fewer number of transmit/receive modules by a factor of 1/N where N is the number of panels, thus making the antenna less costly. The modules can be switched into the respective antenna elements positioned on a selected antenna face. The present phased array antenna also provides a 360° azimuth, and an inclined planar antenna face having an array of antenna elements, which also provides for a high elevation range. The invention provides several other advantages. Only one panel requires calibration because the 8-way switch, radio frequency cables, and antenna elements are phase matched. This reduces the calibration time by ⅛ and reduces any required memory storage in a controller by ⅛.

Figure 1:
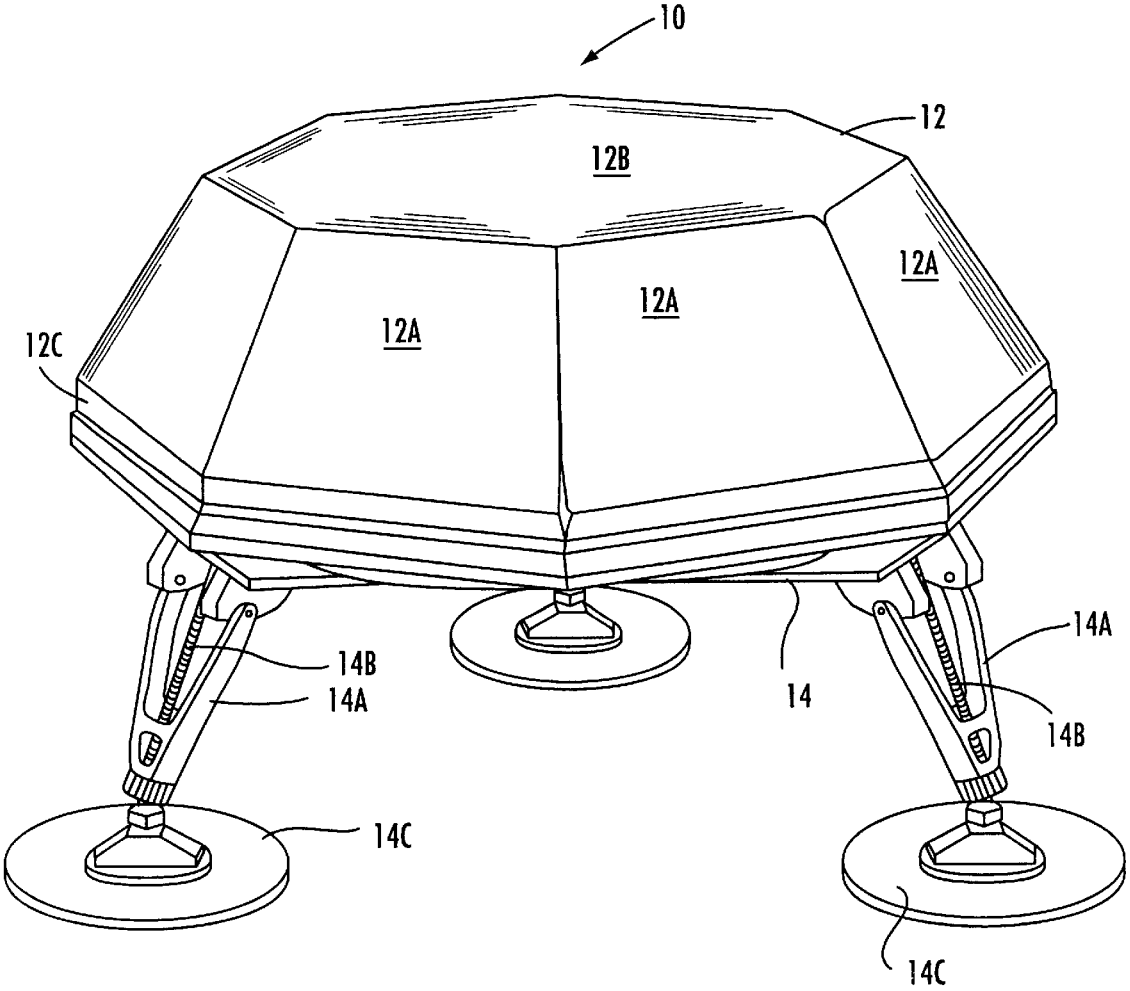
FIG. 1 is an environmental prospective view of the phased array antenna of the present invention.
Figure 2:
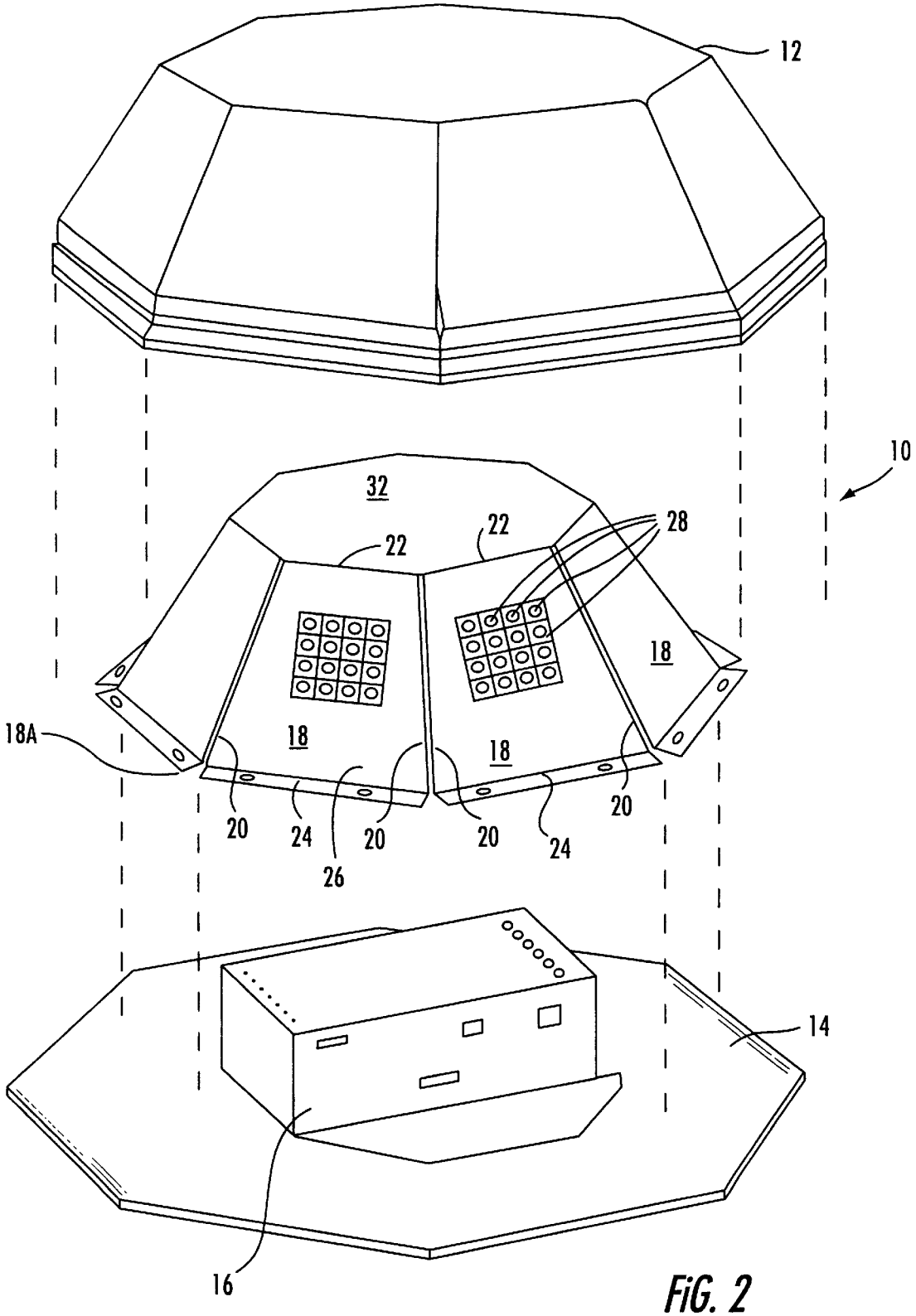
FIG. 2 is an exploded isometric view of the phased array antenna of FIG. 1, showing the trapezoid configured panels and a base that supports the electronic components.

FIG. 1 illustrates an environmental perspective view of the completed phased array antenna, indicated generally at 10. As illustrated in FIG. 2, an antenna cover housing 12 received over a base 14, which supports the electronic components formed in an electronics enclosure 16. The base 14 includes legs 14*a* connected on the undersurface to make the unit mobile. The legs 14*a* have an adjustable screw 14*b* and ground engaging pads 14*c*. The base 14 also supports the eight trapezoid configured planar panels 18 (FIG. 2) that are each connected together at the side edges to form an octahedron shaped antenna array. As illustrated in greater detail in FIG. 2, each planar panel 18 is trapezoidal in shape and has opposing sides 20 and top and bottom edges 22, 24 and forms a planar antenna face 26 on which sixteen different antenna elements 28 are positioned. The cover housing 12 is formed as a trapezoid and includes eight trapezoid shaped sides 12*a*, a top 12*b*, and a peripheral flange 12*c* located at the bottom portion.

The planar panels 18 are disposed circumferentially about a central axis, and each panel is connected to adjacent panels along the sides thereof and is inclined toward the central axis from the base 14. As illustrated, the interconnected panels form a trapezoid with an under surface 18*a* which receives the electronic enclosure 16. The panels 18 are typically formed from aluminum or other lightweight sheet material known to those skilled in the art. The panels can be interconnected together by rivets, adhesive, or other fastening means known to those skilled in the art. The particular trapezoidal shape of the eight panels allows a 360° azimuth, while also providing for +15 to +60 degree elevation range for transmitting and receiving signals. Each panel has sixteen different antenna elements 28 that are arranged in a four by four (4×4) matrix, forming the antenna array on each panel's antenna face 26. It should be understood that although sixteen antenna elements are illustrated, many different arrays, such as a five by four (5×4) or four by five (4×5) array, could be used depending on the antenna end use. The total number of antenna elements and their particular arrangement within an array will depend on end use of the antenna and the type of antenna array as suggested by those skilled in the art.

Figures 3, 4:
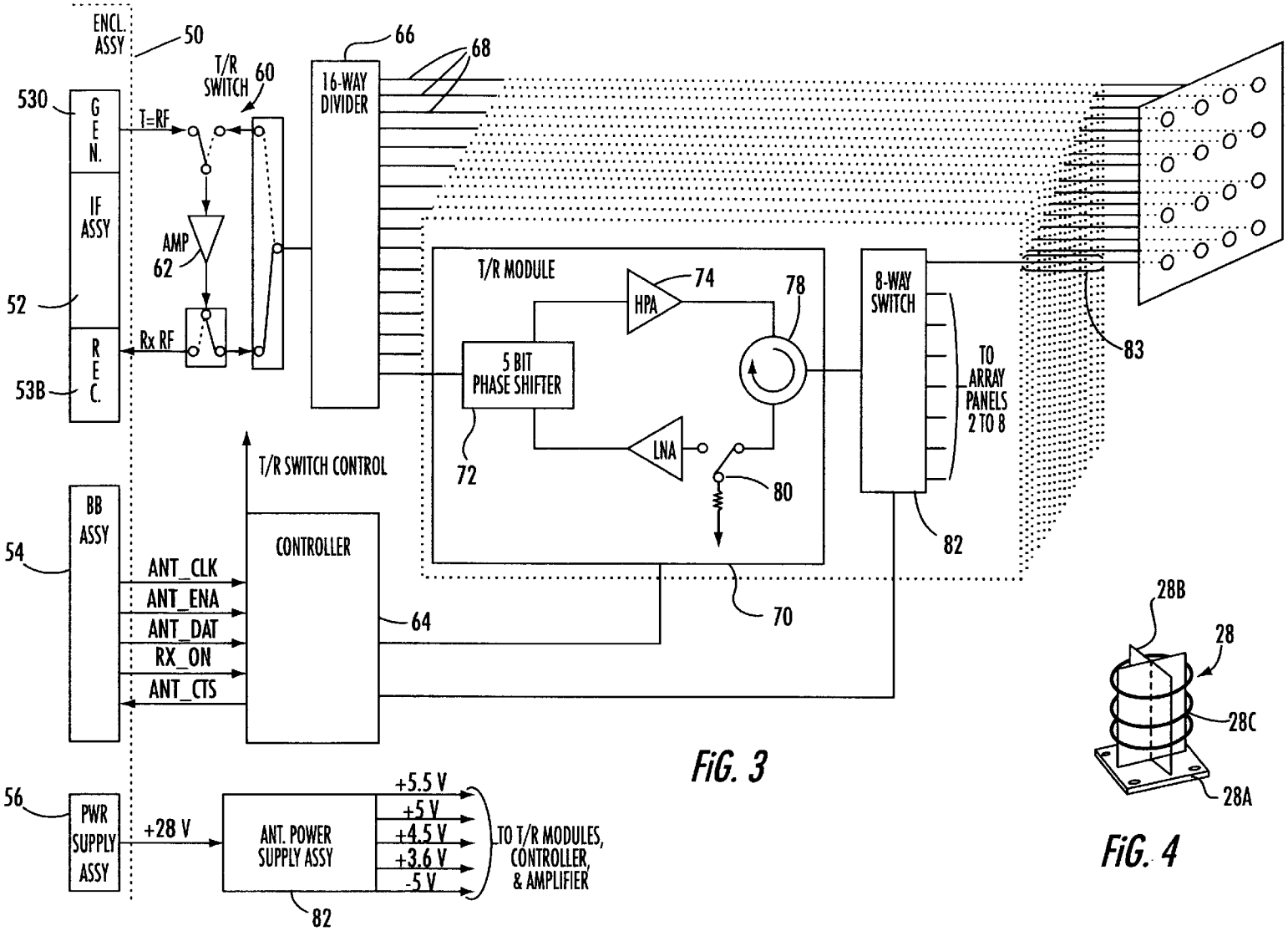
FIG. 3 is an assembly block diagram of the phased array antenna of the present invention.
FIG. 4 is an enlarged view of one antenna element positioned on an antenna face.

Each antenna element 28 comprises a helical antenna element as shown in the enlarged view of FIG. 4. As illustrated, the antenna element 28 includes a conductive base member 28*a* that is attached to an antenna face 18 by appropriate fasteners. A cross-shaped mount 28*b* formed by two intersecting planes allows an antenna coil 28*c* to be wound. In one aspect of the present invention, the antenna elements are circularly polarized in the right-hand direction. Although various operating ranges of antenna elements can be used as known to those skilled in the art, the antenna elements of the present invention have been used with an operating range in the X-Band region. It does not matter what type of antenna elements 28 are used for the present invention as long as the elements provide the beam forming capability for necessary communications in the desired signal range, and are small enough to fit onto the panels as illustrated.

The base is typically formed from aluminum, and is configured as an octahedron to correspond to the octahedron configured bottom edge 24 formed by interconnected panels 18. Each bottom edge 24 of a respective panel 18 includes a support flange 30 that removably mounts onto the peripheral edge of the base 14 and can be attached to the base 14 by respective fasteners such as screws or other removable fastening means known to those skilled in the art. Thus, the base 18 supports the planar panels and adds rigidity and support to the structure via the secured support flange. An octahedron configured top panel 32 can be fastened to the top edge of the panels to provide further support to the plurality of planar panels forming the antenna faces.

As illustrated in FIG. 2, the electronic components of the phased array antenna 10 of the present invention are preferably mounted in the electronics enclosure 16 that rests on the base 14 within the undersurface 18*a* of the connected panels. The electronics enclosure 16 includes the various electronic components set forth in the assembly block diagram of FIG. 3. Thus, the base 14, panels 18 and electronics enclosure 16 are formed as discrete components that can be individually replaced without affecting the other components.

FIG. 3 illustrates the major components that are included within the electronics enclosure 16 shown in FIG. 2. The line 50 at the left of the drawing indicates the start of those components that would be included within the electronics enclosure 16. Those assemblies that communicate with the phased array antenna 10 of the present invention are shown to the left of the line. These components typically are part of other subsystems. For example, an intermediate frequency assembly 52 having a signal generator 56*a* and receiver 53*b* would generate and receive radio frequencies from the phased array antenna 10. Additionally, a base band assembly 54 and a power assembly 56 communicate as known to those skilled in the art. The intermediate frequency assembly 52, base band assembly 54 and power supply assembly 56 all can be included within one type of enclosure assembly that would be connected by appropriate connectors to the phased array antenna 10 of the present invention.

The intermediate frequency assembly 52 generates a transmit radio frequency signal that is transmitted through a transmit/receive switch 60, which is operable with an appropriate amplifier 62 to allow only transmitting or receiving of signals at one time. The transmitted radio frequency signal then passes into a 16-way divider 66 that divides the radio frequency signal into sixteen different components that pass through sixteen respective signal lines 68. A transmit/receive module 70 is connected into each line 68.

Each radio frequency signal passes through a five-bit phase shifter 72 of a respective transmit/receive module 70, which, in turn, is controlled by controller 64 to make it possible to generate the radio frequency power directly at the antenna element 28, and to set the relative phase relationships between the antenna elements 28. The controller 64 establishes the necessary five-bit encoded entry corresponding to the amount of phase shift necessary between the various antenna elements 28 positioned on one antenna face 26, thus allowing beam forming capability. As is typical in many transmit/receive modules 70, each module includes a high power amplifier 74 (HPA) for amplifying the transmit signals, and a low noise amplifier (LNA) for amplifying any received signals. All transmitted and received signals pass through a circulator 78 of the transmit/receive module 70 as is well known to those skilled in the art. Another switch and resistor circuit 80 off the circulator 78 provides greater isolation to the overall circuit.

The signals from each transmit/receive module 70 then pass into an eight-way switch 82, which is connected via appropriate cable and connector 83 so that each transmit/receive module will automatically be switched into a selected antenna array corresponding to one selected panel 18. The controller 64 also includes appropriate circuitry for controlling the eight-way switch operation.

The electronic enclosure can also include an antenna power supply assembly 82 that receives power from power assembly 56, and provides necessary splitting of current to provide power to the transmit/receive modules 70, controller 64 and amplifiers 74, 76. The controller 64 also receives control information from the base band assembly 34, including timing signals for the antenna clock (ANT-CLK), antenna enable signals (ANT-ENA), antenna data (ANT-DAT), and receive on signals (RX_ON). The ANT_CTS signal corresponds to an antenna clear to send signal. These signals indicate that the antenna is now ready to receive any radio frequency signals. Using those transmit/receive modules 70 known to those skilled in the art, it is now possible to obtain an effective isotropic radiated power (EIRP) of 20 dBW.

In operation, the controller 64 could send to the base band assembly 54 an ANT_CTS signal, indicating that the antenna is ready to receive command from the baseband assembly. The intermediate frequency generator of the IF assembly 52 then generates a radio frequency signal that passes through the transmit/receive switch 60 into the 16-way divider, which splits the signal into respective transmit signals. These signals are phase shifted within the phase shifter 22 of each respective transmit/receive module 70. The controller 64 automatically adjusts the amount of phase shift corresponding to any previously known calibration. The signal is amplified by the high power amplifier 74 and then passes through circulator 78 into the eight-way switch 82, where the signal is then respectively generated to the desired panel and to a respective antenna element via appropriate cable and connector 83. The signal has been phase shifted as desired. In a similar format, signals are received in antenna elements 28 and passed through the circulator 78, low noise amplifier 76 and phase shifter 72, and through the 16-way divider 66, where the received signals can be combined and interpolated by the intermediate frequency assembly.

During operation, the T/R switch 82 may switch from receive to transmit in less than 1 ms, depending on operational variables as known to those skilled in the art.

The present phased array antenna is advantageous because it provides a plurality of different planar panels 18, each forming a planar antenna face 26 having an array of antenna elements, while also providing 360° azimuth and a beam formation/receiving of between about +15 to +60 degrees elevation. Naturally, the elevation can vary depending on the angle inclination of each panel.

The phased array antenna of the present invention also is advantageous because it is power efficient using only a fraction of the total transmit/receive modules that would be necessary, if one transmit/receive module were positioned behind each antenna element. The unique configuration of the trapezoid configured panels 18 that are connected at their side edges provides a firm structure that allows an octahedron shape to be formed. This shape is advantageous to provide not only 360° azimuth, but also a sturdy structure that can be supported by a base having depending legs. Thus, the structure is light weight and portable. Also, the straight lines of the panels permit a cover housing 12 to be positioned over the panels and connected to the base 14.

The present invention is also advantageous because only one panel requires calibration because the eight-way switch, radio frequency cables, and antenna elements are phase matched. This reduces the calibration time by ⅛ and also reduces the required memory storage in the controller by ⅛. It is also possible to form multiple beams using multiple panels simultaneously by controlling the 8-way switches appropriately, although it is not anticipated that the antenna would be used in this fashion.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A phased array antenna comprising:

a plurality of planar panels each having opposing sides and top and bottom edges and forming an antenna face, wherein said planar panels are disposed circumferentially about a central axis, each panel connected to adjacent ones along the sides thereof and inclined toward the central axis from the bottom edge;

a plurality of antenna elements positioned on each panel and forming an antenna array on each antenna face;

a plurality of transmit/receive modules for generating and receiving signals, each transmit/receive module corresponding to a respective antenna element on an antenna array, wherein each transmit/receive module further comprises a phase shifter;

means for connecting each of said transmit/receive modules to respective pluralities of said antenna elements within each array; and switch means for selectively controlling connection of said transmit/receive modules to respective antenna elements of one selected antenna array so that the transmit/receive modules are collectively connected to respective antenna elements of a selected antenna array at a selected time, such that the phase relationships among the antenna elements on an antenna array can be set, wherein said switch means and said plurality of antenna elements are phase matched to each other.

2. A phased array antenna according to claim 1, wherein said planar panels are substantially trapezoidal in shape.

3. A phased array antenna according to claim 1, wherein said plurality of planar panels comprise eight panels forming an octahedron.

4. A phased array antenna according to claim 1, and further comprising a base for supporting said transmit/receive modules, connecting means, and switch means, and means connecting said base along the bottom edges of said panels.

5. A phased array antenna according to claim 1, wherein said panels are inclined at an angle such that the antenna elements cover a +15 to +60 degree elevation when transmitting and receiving signals.

6. A phased array antenna according to claim 1, wherein said antenna elements further comprise helical antennas.

7. A phased array antenna according to claim 1, wherein each panel forming an antenna face comprises sixteen antenna elements.

8. A phased array antenna according to claim 1, wherein said antenna elements on each panel are arranged in a 4×4 matrix.

9. A phased array antenna according to claim 1, and further comprising means for generating a radio frequency signal, and a signal divider connected to said plurality of transmit/receive modules for receiving said generated radio frequency signal and dividing said radio frequency signal into separate signals to said transmit/receive modules.

10. A phased array antenna according to claim 1, wherein said means for generating a radio frequency further comprises a transmit/receive switch for switching between transmit and receive modes.

11. A phased array antenna according to operatively connected to said switching means for controlling the switching of said switching means.

12. A phased array antenna according to claim 1, and further comprising a top, and means connecting said planar top along the top edges of said panels.

13. A phased array antenna comprising:

a plurality of panels each having opposing sides and top and bottom edges and forming an antenna face, wherein said panels are disposed circumferentially about a central axis, each panel connected to adjacent ones along the sides thereof and inclined toward the central axis from the bottom edge;

a plurality of antenna elements positioned on each panel and forming an antenna array on each antenna face;

a plurality of transmit/receive modules for generating and receiving signals, each transmit/receive module corresponding to a respective antenna element on an antenna array, each transmit/receive module further comprising a phase shifter to establish the phase of a respective transmit/receive module output relative to other transmit/receive modules to thereby direct a desired beam;

means for connecting each of said transmit/receive modules to respective pluralities of said antenna elements within each array;

switch means for selectively controlling connection of said transmit/receive modules to respective antenna elements of one selected antenna array so that the transmit/receive modules are collectively connected to respective antenna elements of one selected antenna array at a selected time, wherein said switch means and said plurality of antenna elements are phase matched to each other; and a controller operatively connected to said transmit/receive modules and said switch means for controlling said switch means and said phase shifters for selecting an array of antenna elements and setting phase relationships among antenna elements on a selected antenna array.

14. A phased array antenna according to claim 13, wherein said panels are substantially trapezoidal in shape.

15. A phased array antenna according to claim 13, wherein said plurality of panels comprise eight panels forming an octahedron.

16. A phased array antenna according to claim 13, and further comprising a base for supporting said transmit/receive modules, connecting means, and switch means, and means connecting said base along the bottom edges of said panels.

17. A phased array antenna according to claim 13, wherein said panels are inclined at an angle such that the antenna elements cover a +15 to +60 degree elevation when transmitting and receiving signals.

18. A phased array antenna according to claim 13, wherein said antenna elements further comprise helical antennas.

19. A phased array antenna according to claim 13, wherein each panel forming an antenna face comprises sixteen antenna elements.

20. A phased array antenna according to claim 13, wherein said antenna elements on each panel are arranged in a 4×4 matrix.

21. A phased array antenna according to claim 13, and further comprising means for generating a radio frequency signal and a signal divider connected to said plurality of transmit/receive modules for receiving said generated radio frequency signal and dividing said radio frequency signal into separate signals to said transmit/receive modules.

22. A phased array antenna according to claim 13, wherein said means for generating a radio frequency further comprises a transmit/receive switch for switching between transmit and receive modes.

23. A phased array antenna according to claim 13, and further comprising a top, and means connecting said top along the top edges of said panels.

24. A phased array antenna according to claim 13, wherein said panels are substantially planar.

25. A phased array antenna according to claim 13, wherein each panel has substantially the same number of antenna elements as adjacent panels.

26. A phased array antenna comprising:

a plurality of planar panels each having opposing sides and top and bottom edges and forming an antenna face, wherein said planar panels are disposed circumferentially about a central axis, each panel connected to adjacent ones along the sides thereof and inclined toward the central axis from the bottom edge;

a plurality of antenna elements positioned on each panel and forming an antenna array on each antenna face;

a plurality of transmit/receive modules for generating and receiving signals, each transmit/receive module corresponding to a respective antenna element on an antenna array, wherein each transmit/receive module further comprises a phase shifter;

means for connecting each of said transmit/receive modules to respective pluralities of said antenna elements within each array;

switch means for selectively controlling connection of said transmit/receive modules to respective antenna elements of one selected antenna array so that the transmit/receive modules are collectively connected to respective antenna elements of a selected antenna at a selected time, such that the phase relationships among the antenna elements on an array can be set, wherein said switch means and said plurality of antenna elements are phase matched to each other;

a base for supporting said transmit/receive modules, connecting means and switch means;

means connecting said base along the bottom edges of said panels; and a plurality of legs depending from said base for supporting said base and panels.

27. A phased array antenna according to claim 26, wherein said planar panels are substantially trapezoidal in shape.

28. A phased array antenna according to claim 26, wherein said plurality of planar panels comprise eight panels forming an octahedron.

29. A phased array antenna according to claim 26, wherein said panels are inclined at an angle such that the antenna elements cover a +15 to +60 degree elevation when transmitting and receiving signals.

30. A phased array antenna according to claim 26, wherein said antenna elements further comprise helical antennas.

31. A phased array antenna according to claim 26, wherein each panel forming an antenna face comprises sixteen antenna elements.

32. A phased array antenna according to claim 31, wherein said antenna elements on each panel are arranged in a 4×4 matrix.

33. A phased array antenna according to claim 26, and further comprising means for generating a radio frequency signal and a signal divider supported by said base and connected to said plurality of transmit/receive modules for receiving said generated radio frequency signal and dividing said radio frequency signal into separate signals to said transmit/receive modules.

34. A phased array antenna according to claim 26, wherein said means for generating a radio frequency further comprises a transmit/receive switch for switching between transmit and receive modes.

35. A phased array antenna according to claim 26, and further comprising a controller operatively connected to said switching means for controlling the switching of said switching means.

36. A phased array antenna according to claim 26, and further comprising a top, and means connecting said top along the top edges of said panels.

37. A phased array antenna according to claim 26, and further comprising a cover housing received over the plurality of panels, and connected to said base.

38. A phased array antenna according to claim 26, wherein said panels are substantially planar.

39. A phased array antenna according to claim 26, wherein each panel has substantially the same number of antenna elements as adjacent panels.

* * * * *